United States Patent [19]

Gabus

[11] 4,191,481

[45] Mar. 4, 1980

[54] ANALOGICAL CONTROL DEVICE FOR A TYPEWRITING MACHINE TO BE USED BY HANDICAPPED PERSONS

[75] Inventor: Jean-Claude Gabus, Hauterive, Switzerland

[73] Assignee: Carba S.A., Berne, Switzerland

[21] Appl. No.: 877,770

[22] Filed: Feb. 14, 1978

[30] Foreign Application Priority Data

Nov. 23, 1977 [CH] Switzerland ..... 14332/77

[51] Int. Cl.[2] ..... B41J 5/30

[52] U.S. Cl. ..... 400/87; 400/83; 340/365 R

[58] Field of Search ..... 400/83, 87; 340/365 R

[56] References Cited

FOREIGN PATENT DOCUMENTS 1236110 6/1971 United Kingdom ..... 400/87

OTHER PUBLICATIONS

IBM Technical Disclosure Bulletin, "Character Display and Input Device," Altman, vol. 15, No. 5, Oct., 1972, p. 1619.

1973 Carnahan Conference on Electronic Prosthetics, "Typewriter for Teaching Severely Handicapped Children," Harding et al., pp. 43–46, Sep., 1973.

*Primary Examiner*—Ernest T. Wright, Jr.

*Attorney, Agent, or Firm*—Young & Thompson

[57] ABSTRACT

The invention relates to an analogical control of a typewriting machine, for use by handicapped persons which comprises a linear display comprising as many positions as there are characters or functions to be printed or controlled, each character or function being associated with a utilization circuit, and which comprises further a variable speed scanning device of said display in order to select a desired character or function; the stopping of the scanning on a given position causing the energization of the corresponding utilization circuit.

7 Claims, 2 Drawing Figures

ANALOGICAL CONTROL DEVICE FOR A TYPEWRITING MACHINE TO BE USED BY HANDICAPPED PERSONS

The present invention relates to control devices for typewriting machines to be used by handicapped persons, that is to say by persons who for example are able to make only certain limited movements such as pushing on one or two press buttons.

There are numerous devices of this kind but they all suffer from an important drawback, their slowness. In fact with typewriters equipped with control devices adapted for handicapped persons, whether mechanical or pneumatical, the speed of writing for a well-trained handicapped person cannot exceed 70 to 100 characters per minute. This slowness is a serious handicap for the users of this kind of typewriter. That is why the present invention has for its aim to create a control device of a typewriter for handicapped persons which will be at least able to double the number of characters per minute without the need of closer attention and without tiring the user.

The present invention has for its object an analogical control device, for example of a typewriting machine for handicapped persons which distinguishes itself by the fact that it comprises a linear display comprising as many positions as there are characters or functions to be printed or controlled, each character or function being associated with a utilization circuit, by the fact that it comprises a variable speed scanning device of this display in order to select a desired character or function and by the fact that the stopping of the scanning on a given position causes the excitation of the corresponding utilization circuit.

All the existing systems use, for the identification of the character or of the function to be controlled, a constant speed scanning of a display. This leads to the use of two coordinate displays to reduce the number of steps for reaching the different positions and thus to reduce the access time. It is apparent that despite this the access speed to a desired position of the display remains too slow.

Therefore according to the present invention one proceeds in a completely different manner. One uses a linear display but a variable scanning speed so that the user can choose at will the instantaneous scanning speed to reach a given position of the display in a minimum of time, time which is nearly identical for all the positions, therefore greatly increasing the typing rate which can be obtained.

The control device according to the present invention comprises a linear display having as many positions as there are characters or functions to be printed or controlled; a variable speed scanning device enabling the selection of one of these positions and the actuation of a control circuit corresponding to the selected position; and utilization circuits associated with each of the positions of the display and actuated by a corresponding control circuit.

Figure 1:
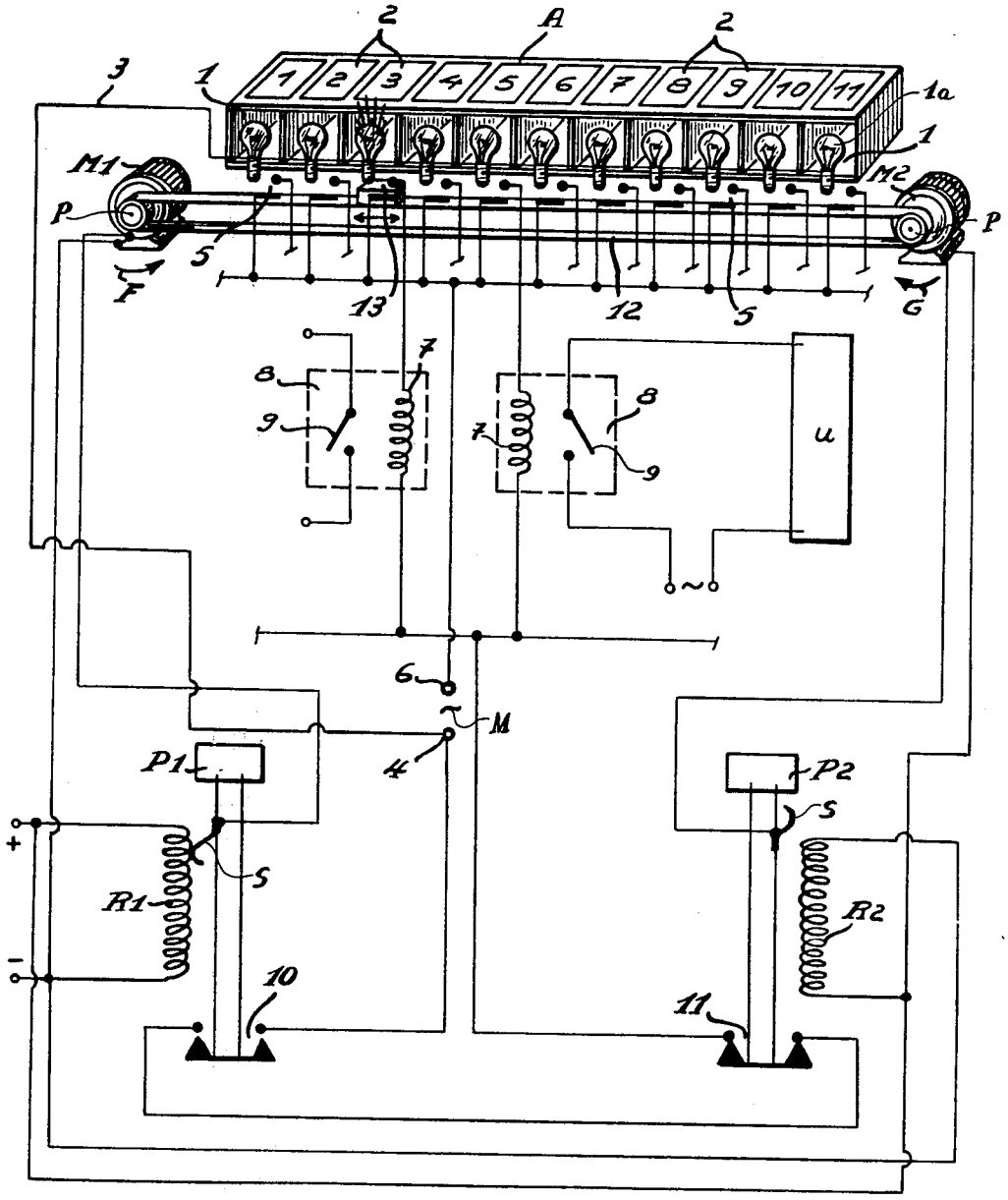
FIG. 1 shows schematically a first embodiment of the invention.

The embodiment of FIG. 1 comprises a linear display A formed of juxtaposed compartments 1 having each a transparent sighting face 2 provided with sign, cipher, letter or other symbol corresponding to a character to be printed or to a function having to be realized.

In the example shown, this display A comprises eleven compartments 1 carrying the ciphers 1 to 11, but in the case of the control of a typewriting machine there may be 30 to 50 compartments corresponding each to a key of the typewriting machine. Each compartment 1 comprises a signal lamp 1*a* which illuminates the compartment 1 or display position choosen or selected by the scanning device. The body or ground of each incandescent lamp 1*a* is connected by mean of an electrical lead 3 to one of the poles 4 of a low voltage distribution main M.

Each compartment 1 is associated with a control circuit comprising a control contact 5 one connection of which is connected to the other pole 6 of the low voltage distribution main M whereas the other connection of this contact 5 is connected to the coil 7 of a relay 8 controlling the contact 9 of the utilization circuit U associated with the corresponding compartment 1. The other end of the coil 7 is connected through the contacts 10, 11 to the pole 4 ot the low voltage distribution main M. Thus for a given utilization circuit U to be activated it is necessary that the corresponding control contact 5 be closed and that the two contacts 10, 11 be also closed.

The control device comprises further a variable speed scanning device of the display A and of selection of a position thereof and thus of a desired utilization circuit U.

In the example shown this scanning device comprises two electrical motors M1, M2 the driving pulleys P of which are connected by means of an endless belt 12. When the motor M1 is energized with current it revolves in the direction of the arrow F whereas the motor M2 revolves in the direction of the arrow F whereas the motor M2 revolves in the direction of the arrow G when energized. When they are not energized the pulleys P of the motors M1 and M2 are idle.

The endless belt 12 carries a metallic contact piece 13 which when aligned with one compartment 1 of the display A enters in contact simultaneously with the active pole of the corresponding lamp 1*a* and with the two connections of the contact 5 corresponding to said compartment 1. This causes the closure of the contact 5 and the feeding of the lamp 1*a* corresponding to the compartment 1 with which the metallic contact piece 13 is aligned.

Each motor M1, M2 is fed by a variable resistor R1, R2 the sliding parts of which is fast with a push button P1, P2. Thus in the case shown, the push button P2 is in its inactive rest position, the motor M2 is not energized and the contact 11 is closed. On the other hand, the push button P1 is slightly depressed so that its stroke is at the beginning of the variable resistor R1 and the motor M1 is fed under low voltage and revolves therefore at a low speed; the contact 10 is open. Thus the metallic contact piece 13 is displaced at the speed chosen by the distance the push button P1 is depressed, towards the left of FIG. 1. When the desired compartment 1 approaches, the user relieves the push button P1 reducing the speed of displacement of the metallic contact 13 which facilitates the selection. When the desired compartment is lighted the push button P1 is completely released, the motor M1 is stopped and the contact 10 is closed. The relay 8 is actuated and the utilization circuit U corresponding to the selected compartment 1 is actuated. By actuating the push button P2 one displaces the metallic contact 13 in the opposite direction i.e. towards the right.

With the aid of such a control device a handicapped person can control an electrical typewriting machine at a rate higher than 150 characters per minute, up to 300 characters per minute and more.

This very astonishing result, which more than doubles the capacity of the now known devices is due to two essential and original characteristics:

1. The absence of any code for the control. Thus anybody may without difficulty immediately use the device.
2. The selection of the function to be controlled at a variable speed, the value of which is controlled by the user.

To make the control still easier, one may delay the relay 8, of the order of 1 to 2 seconds so that if the user sees that he stopped the luminous spot of the display A on a wrong compartment 1 he may be actuating one or the other push button P1 or P2 correct this error before the erroneously selected function is effectively controlled.

Numerous variants of the described device can be conceived, particularly for the scanning device which may be pneumatic, or for the display which may be mechanical. The essential feature of this embodiment is always to have two analogical entries controlling the selection of a position of the display from the left to the right or inversely, at a speed which can be chosen at will.

Figure 2:
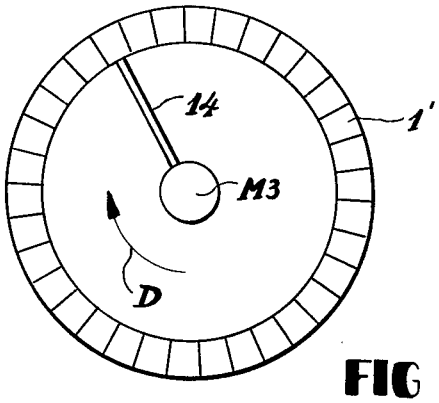
FIG. 2 shows schematically a second embodiment thereof.

In another variant, if the linear display is designed to be closed on itself, for example circular, it is even possible to have only one analogical entry. Such a device is shown diagrammatically in FIG. 2, in which the juxtaposed compartments 1' are shown in a closed circular configuration, the scanning device 14 rotating always in the same direction D at a selectively variable speed of rotation under the impetus of a motor M3 and under the control of circuitry embodying on a single control member and which is otherwise the same as in FIG. 1 and so is not illustrated.

I claim:

1. Analogical control device, particularly of a typewriting machine, for use by handicapped persons comprising a linear display having as many positions as there are characters and functions to be printed or controlled, each character and function being associated with a utilization circuit; a continuously variable speed scanning device of said display to select a desired character or function; and means whereby stopping the scanning on a given position causes the energization of the corresponding utilization circuit.

2. Device according to claim 1 in which the display is not closed on itself.

3. Device according to claim 2 in which the display is rectilinear.

4. Device according to claim 1 in which the display is closed on itself.

5. Device according to claim 3 in which the scanning device comprises two control members, one for scanning in one direction and the other one for scanning in the opposite direction.

6. Device acording to claim 4 in which the scanning device comprises only one control member, the scanning occuring always in the same direction.

7. Device according to claim 1 in which said continuously variable speed scanning device comprises a variable resistor, a slider movable along said variable resistor continuously to vary the speed of scanning, and means under the control of a said handicapped person for moving said slider along said resistor thereby to select the speed of scanning.

* * * * *